US005344375A

United States Patent [19]

Cooper

[11] Patent Number: 5,344,375

[45] Date of Patent: Sep. 6, 1994

[54] GRAVITY BIASED EXERCISE APPARATUS

[76] Inventor: Gary L. Cooper, HC-4, Box 62, Pocahontas, Ark. 72455

[21] Appl. No.: 8,512

[22] Filed: Jan. 25, 1993

[51] Int. Cl.[5] ..... A63B 21/075

[52] U.S. Cl. ..... 482/106; 482/108

[58] Field of Search ..... 482/106, 107, 108, 92, 482/109, 148, 93, 94

[56] References Cited

U.S. PATENT DOCUMENTS

| | | | |
|---|---|---|---|
| 76,944 | 4/1868 | Reilly . | |
| 1,316,683 | 9/1919 | Calvert . | |
| 1,779,594 | 10/1930 | Hall . | |
| 2,640,696 | 6/1953 | Lemieux | 272/84 |
| 2,676,802 | 4/1954 | Obrien | 482/106 |
| 3,771,785 | 11/1973 | Speger | 482/106 |
| 3,825,253 | 7/1974 | Speyer | 272/84 |
| 4,103,887 | 8/1978 | Shoofler | 482/106 |
| 4,369,968 | 1/1983 | Price | 482/106 |
| 4,639,979 | 2/1987 | Polson | 24/270 |
| 4,756,526 | 7/1988 | Broussara | 482/108 |
| 4,822,034 | 4/1989 | Shields | 272/123 |
| 4,971,318 | 11/1990 | Tracy | 272/123 |
| 5,102,124 | 4/1992 | Diodati | 482/107 |
| 5,137,502 | 8/1992 | Anastas | 482/106 |
| 5,154,681 | 10/1992 | Denney | 482/106 |

*Primary Examiner*—Richard J. Apley
*Assistant Examiner*—Jerome W. Donnelly
*Attorney, Agent, or Firm*—Polster, Lieder, Woodruff & Lucchesi

[57] ABSTRACT

In an exercise apparatus for exercising having a horizontal bar and a plurality of weights, the weights including a bar receiving slot opening through the lower edge of the weight, and a closed end intermediate the height of the weight and above the center of gravity of the weight when the bar is at the closed end of the slot, the weight being gravity biased to a position where the open end of the slot is below the bar.

13 Claims, 2 Drawing Sheets

GRAVITY BIASED EXERCISE APPARATUS

BACKGROUND OF THE INVENTION

The present invention relates to exercise equipment which utilizes weights for resistance. This may include barbell equipment as well as weight resistance machines.

Barbells are most commonly assembled by placing doughnut shaped weights on opposite ends of a bar and securing the weights with restraining collars. This embodiment has obvious limitations in regard to the speed and selectivity of changing the desired weight units.

Safety is a primary concern in exercising. In an effort to speed the process of loading the weight on and unloading the weight from the bar, restraining collars are sometimes neglected which may result in an injury due to weights sliding off one end of the bar. Additionally, even when collars are used, they may be faulty or improperly adjusted and fail.

An alternative to doughnut shaped weights is disclosed in U.S. Pat. No. 76,944, issued to F. W. Reilly on Apr. 21, 1868. This approach uses a radial slot to load individual weights. However, this approach is limited to vertical bar movements as horizontal bar movements would cause the weights to accidentally unload. Means to overcome this tendency have been attempted in various ways, such as U.S. Pat. No. 4,971,318, issued to J. W. Tracy on Nov. 20, 1990, which utilizes latching hinged halves; U.S. Pat. No. 4,822,034, issued to W. D. Shields on Apr. 18, 1989, which pin locks radial slot weights; and U.S. Pat. No. 3,825,253, issued to H. J. Speyer on Jul. 23, 1974, which loads and unloads weights by way of angularly cut slots. However, even with these improvements, loading-unloading the weights from the bar process is clumsy, time consuming and does not allow unrestricted weight selection.

One of the objects of the present invention is to provide for a system of loading and unloading weights from a bar quickly and easily.

Another object is to provide a means whereby any single weight unit may be loaded on or and unloaded from a bar without adjustment of any other component.

Another object is to provide a means whereby multiple weight units may be simultaneously loaded on or unloaded from a bar without adjustment of any other component.

Another object is to provide an exercise apparatus which eliminates the need to manipulate restraining collars into proper position.

Another object is to provide an exercise apparatus that is safe.

Another object is to provide a means to determine proper speed and motion of use for curls with a rhythmical swing.

Another object is to provide a means within the weights to permit quick and easy placement of the weights into position.

Another object is to provide a shape which allows the weights to be placed in resting position preventing movement away from where they were originally placed.

Another object is to provide an exercise apparatus that may be conveniently stored in a useful way.

Other objects will become apparent to those skilled in the art in light of the following description and accompanying drawings.

SUMMARY OF THE INVENTION

In accordance with the present invention, generally stated, an exercise apparatus is provided that includes a horizontal bar with weights mounted on the bar, a plurality of weights each having a bar receiving slot opening through a lower edge of the weight and a closed end intermediate the height of the weight and above the center of gravity of the weight when the bar is at the closed end of the slot, whereby the weight is gravity biased to a position at which the open end of the slot is below the bar, means for preventing axial displacement of the weights, and means for maintaining the bar at the closed end of the slots when the apparatus is resting on a surface. The weight is gravity biased by placing a preponderance of weight below the bar center of gravity. This keeps the weight slot pointed generally down, holding the weight on the bar during proper horizontal bar usage.

The preferred embodiment includes safety latch means to prevent the weight from sliding off if it is moved to a position at which the open end of the slot is above the bar. The safety latch means stops the weights from falling off the bar during rotary exercise that is too rapid to maintain the gravity biased positioning.

The present invention also provides a means of preventing lateral movement of the weights. The weights are restrained from lateral movement on the bar, and from lateral movement completely off of the bar. Spacers may be used to prevent lateral movement of the weights on the bar, and a support weight mounted on each end of the bar prevents lateral movement of the weights off of the bar and supports the slotted weights while the equipment is at rest. The support weights are meant to be relatively constantly loaded.

The weight apparatus includes handles that are integrally formed with the weights. The handles facilitate unloading and loading the weights from and onto the bar.

A tether may be attached to the bottom of the weight beside the slot with the purpose of keeping the slot downwardly oriented. The tether serves as an additional precaution, preventing the weights from being displaced from the bar.

It is to be understood that various changes may be made by one skilled in the exercise apparatus art to one or more of the features of the apparatus disclosed herein without departing from the scope or spirit of the present invention.

BRIEF SUMMARY OF THE DRAWINGS

Referring to the drawings which disclose one advantageous embodiment of the present invention and several modifications thereof.

DESCRIPTION OF THE PREFERRED EMBODIMENT

Figure 1:
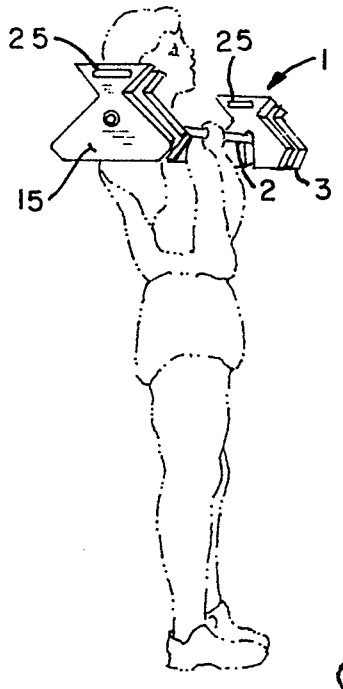
FIG. 1 is a view in perspective of one illustrative embodiment of an exercise apparatus in use.
Figure 3:
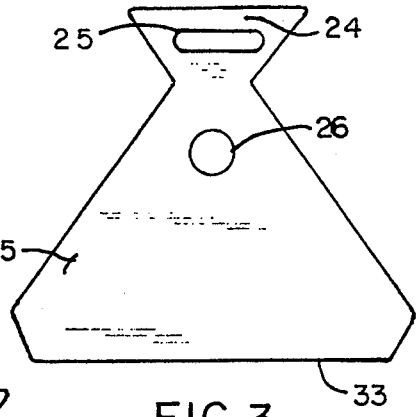
FIG. 3 is a view in front elevation of a fixed end weight.

Referring now to the drawings for one illustrative embodiment of exercise apparatus of this invention, reference numeral 1 indicates a completed assembly, ready for use in exercise.

In particular, the exercise apparatus 1 includes a horizontal bar 2, which supports a plurality of weights 3. Each of the weights 3 is mounted on the bar 2 through a bar receiving slot 4 opening through a flat base surface 33 of the weight 3. The slot has walls parallel with one another and perpendicular to the base surface 33 and to broad side surfaces 25. Intermediate the height of the weight 3 the slot has a closed end 6. When the bar 2 is at the closed end 6 of the slot 4, the bar is above the center of gravity of the weight 3. This distribution of weight makes the weights 3 gravity biased to a position where the open end 5 of the slot 4 is below the bar 2. The gravity biased characteristic of the weights 3 maintains the slot 4 downwardly oriented preventing the weights 3 from falling from the bar 2. In the embodiment shown, the gravity biased weight 3 is trapezoidal. The flat surface of the trapezoidal base eliminates the need to secure the weights into resting position with a weight bench. The flat base allows the weight to be safely dropped to the floor to rest in its normal position with the bar safely elevated without rolling into another position. The weight 3 may also have an upper portion that is lighter in weight than the lower portion. This weight distribution may be achieved by using a weight 3 with an upper portion having a cavity, using a weight 3 with a lower portion comprised of a heavier material than is used for the upper portion above slot 4, or, using a weight with the lower portion weighted because of a greater thickness than that of the upper portion. Another means of gravity biased weight distribution is accomplished by using a completely hollow weight with a capped top and pouring liquid or other fluent material such as sand, or lead or iron shot (e.g. BB shot) into the hollow slot weight container. This embodiment allows for total weight manipulation.

Figure 4:
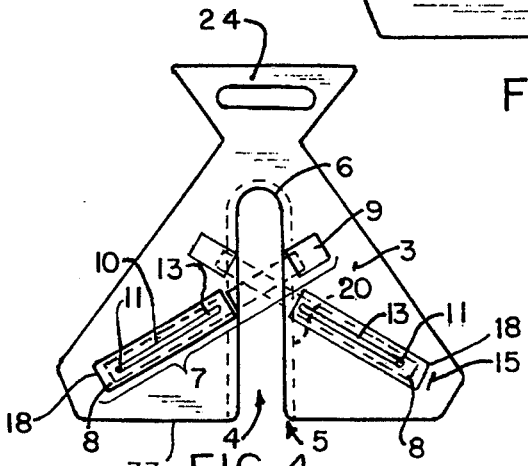
FIG. 4 is a view in front elevation of a weight.
Figure 9:
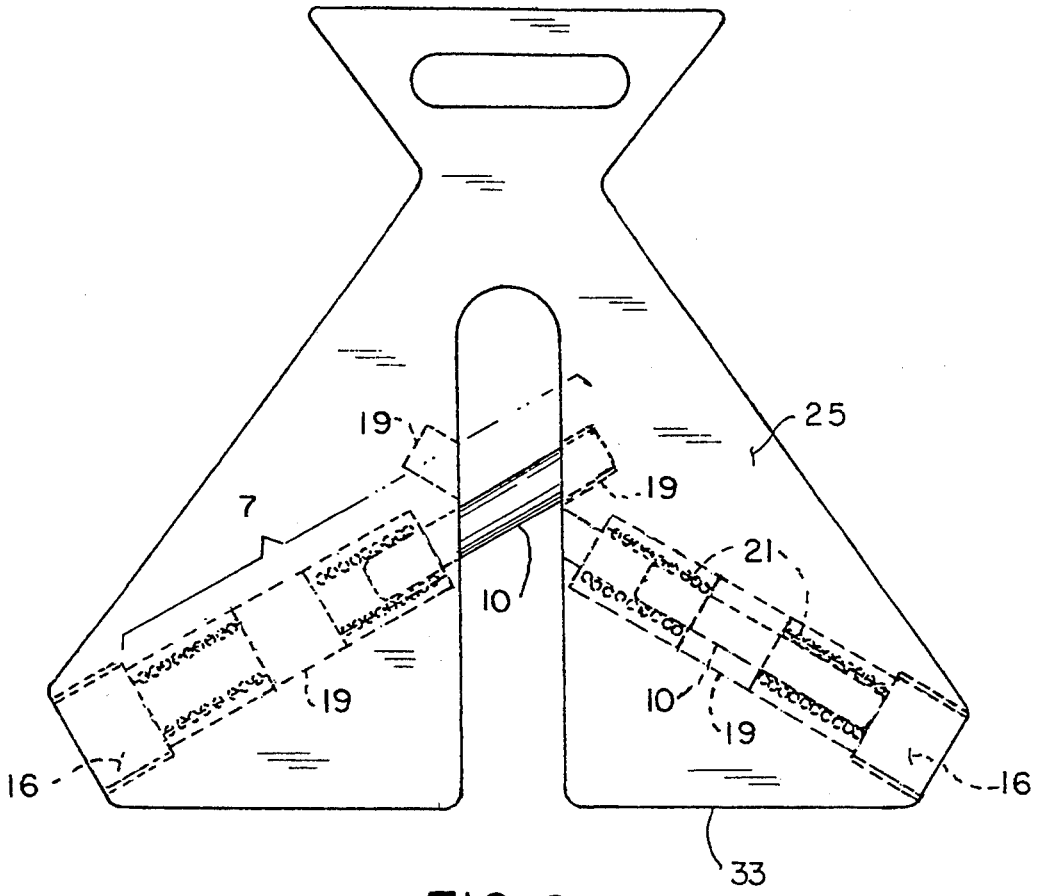
FIG. 9 is a sectional view in front elevation of a weight.

In the preferred embodiment described, the exercise apparatus 1, includes a safety latch means 7 that prevents the weight 3 from falling off the bar 2 when its open end 5 is above the bar 2. FIG. 4 illustrates one embodiment of safety latch means 7. This particular embodiment is a gravity safety pin 10, slidably mounted in a passage 8 in a housing 18. The passage is closed at its lower end and opens into the slot 4 at its upper end. When the slot 4 is rotated up, the gravity safety pin 10 slides across the slot 4 and the slot is blocked. This obstruction keeps bar 2 from passing through the slot 4 and maintains bar 2 in position between the gravity safety pin and the closed end of the slot 6. The gravity safety pin 10 has a post 11 that fits into a radially extending hole near an end of the pin and projects through an elongated opening 13 running axially of the passage 8. The post 11 serves as a stop and a means manually to retract the pin 10. The pin 10 may extend into a holding cap 9 which adds support to the pin as it blocks slot 4. In the embodiment shown, one pin is provided to block slot 4 when the exercise apparatus is rotated clockwise and another pin to block slot 4 when exercise apparatus 1 is rotated counter-clockwise. FIG. 9 illustrates another embodiment of a safety latch means 7. This particular embodiment is a gravity safety pin slidably mounted in a cavity 19 in the weight 3. The cavity 19 is lined with bearings 21 through which pin 10 slides. A plug 16 seals the lower end of cavity 19.

Figure 2:
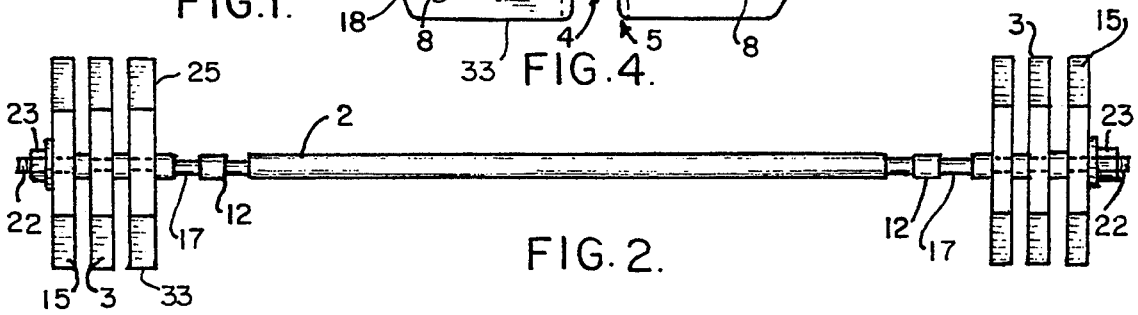
FIG. 2 is a view in top plan of an exercise apparatus of FIG. 1.
Figure 5:
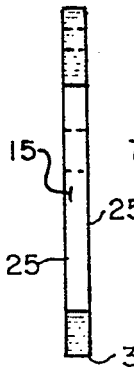
FIG. 5 is a view in side elevation of FIG. 3.
Figure 6:
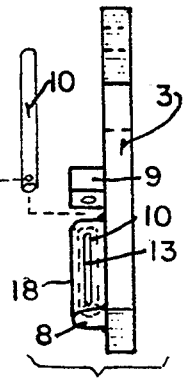
FIG. 6 is an exploded view in side elevation of FIG. 4.
Figure 8B:
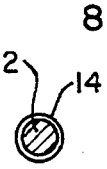
FIG. 8B is a cross-sectional view of the horizontal bar taken along line 8B of FIG. 8A.
Figure 8A:
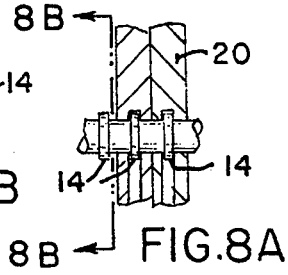
FIG. 8A is a partial longitudinal section, partially broken away, of another embodiment of a horizontal bar with means for preventing lateral movement, with weights in place thereon.
Figure 7:
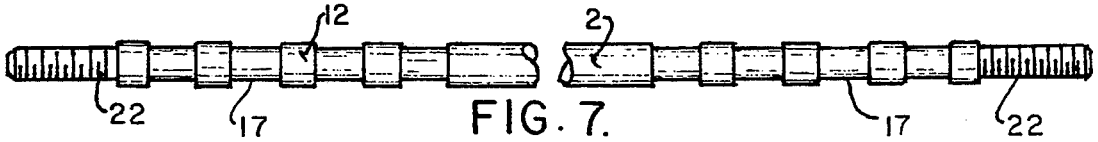
FIG. 7 is a view in front elevation of a horizontal bar.

In the embodiment shown in FIGS. 2 and 7, the bar has sections 17 of reduced diameter to create between them spacers 12 that are integral with the bar 2 as a means of preventing lateral movement. The slots of the weights 3 are wider than the diameter of the sections 17 and narrower than the diameter of the spacers 12. The weights 3 are slid into position on the bar 2 between the spacers 12. The weights 3 are not dependant on each other for placement. Their positions are maintained independently by spacers 12. In another embodiment, shown in FIG. 8, the means preventing lateral movement includes annular ribs 14 on the bar 2, and grooves 20 in the walls defining the side walls of weight slot 4. The annular ribs 14 are concentric about the bar 2 and slide in the grooves 20, to preclude substantial lateral movement of weights 3. In another embodiment, a means of preventing lateral movement includes magnets attached to the weights 3. The magnets secure weights 3 to each other and to fixed end weights 15. In the embodiment of weight 3 shown in FIG. 4, the weight is made to accommodate either the form of restraining means shown in FIG. 2 or in FIG. 8. If only the spacers 12 are to be used, the grooves 20 need not be provided.

Fixed end weights 15 attach at either end of bar 2 to prevent weights 3 from moving laterally beyond the outer ends 22 of bar 2. Fixed end weights 15 are unslotted and provided with an aperture 26 through which an end of the bar extends to mount the weights on the outer ends 22 of the bar. In the embodiment shown, the ends of the bar are threaded and the end weights 15 are secured to the outer ends 22 with an complimentarily threaded fastener 23. Fastener 23 may also be a pinch collar that slides onto bar 2, or any other conventional form of a fastener, the fastener forming no part of this invention. The fixed end weights are preferably of sufficient height from their base edge to the aperture 23 to ensure that the bar is at greater than chest height when the apparatus is resting on the ground or floor, and that none of the weights 3 is of greater corresponding height.

Handles 24 may be and preferably are integrally formed with the weights 3. Preferably they are constructed with a hand hold 25 of a width sufficient to allow easy grasping. Handles 24 facilitate the process of selectively loading and unloading the weights 3 to and from bar 2. In addition, the upper surfaces of the integral handles 24 are flat so that when weights 3 are resting on the floor or other support surface, with the flat surfaces all facing upward, handles 24 can serve to support a table top. The table top is secured to the handles 24 by means of screws inserted through the table top into the handles 24.

A tether may be attached to the weights to prevent weights 3 from falling off bar 2 through slots 4. The tether is attached at open end 5 of slot 4 and connected to the floor. This additional restraint of the weights keeps slot 4 downwardly oriented, preventing weights 3 from dislodging during use.

Numerous variations, within the scope of the appended claims, will be apparent to those skilled in the art in light of the foregoing description and accompanying drawings. For example, the weights 3 may be any shape and have a slot 4 of any radial length as long as a majority of weight is placed below the center of gravity of the bar 2. The safety latch means can take any desired form, such as detent balls or pawls, spring biased or gravity biased. The pin 10 can be spring-biased to holding position, and retracted by means of the post 11, in which case only one pin need be used. It is intended that all matter contained in the above description or shown in the accompanying drawings shall be interpreted as illustrative and not in a limiting sense.

I claim:

1. In an exercise apparatus including a horizontal bar and weights mounted on said bar, the improvement comprising a plurality of weights each having a flat base surface and each having a bar receiving slot opening through said flat base surface and defined by parallel opposed walls, said walls being perpendicular to said flat base surface and to a broad side surface of said weight, said slot having a closed end intermediate the height of said weight and sufficiently above the center of gravity of said weight that when said bar is at the closed end of said slot the bar is above the center of gravity of said weight, whereby said weight is gravity biased to a position at which said open end of said slot is below said bar, said exercise apparatus including unslotted fixed weights at either end of said horizontal bar and means for securing said fixed weights to said bar.

2. The improvement of claim 1 wherein said exercise apparatus includes a safety latch means to prevent said weight from moving to a position at which said open end of said slot is above said bar.

3. The improvement of claim 2 wherein said safety latch means further comprises a safety pin which blocks said slot when said slot is rotated upward.

4. The improvement of claim 1 wherein said exercise apparatus includes means preventing lateral movement of said weights on said bar.

5. The improvement of claim 4 wherein said means preventing lateral movement further comprises spacers on said bar.

6. The improvement of claim 1 wherein said weights have a trapezoidal lower section with a base of said trapezoidal lower section distal to said bar, said trapezoidal lower section preventing rotational movement of said exercise apparatus when said exercise apparatus is positioned on a flat surface.

7. The improvement of claim 1 wherein said integral handles further comprise a flat upper surface.

8. The improvement of claim 7 wherein a plurality of weights each having said integral handle are so spread and arranged that said flat upper surface of said handles is adapted to support a table top.

9. The improvement of claim 1 wherein said weights include integral handles at their upper end, said integral handles permitting said weights to be selectively loaded on and unloaded from said bar.

10. The improvement of claim 1 wherein said end weights support said bar at a height above a floor at a height sufficient to clear the chest of a user lying under said bar when said end weights rest on said floor.

11. In an exercise apparatus including a horizontal bar and weights mounted on said bar, the improvement comprising:

a plurality of weights each having a bar receiving slot opening through a lower edge of said weight and a closed end intermediate the height of said weight and sufficiently above the center of gravity of said weight that when said bar is at the closed end of said slot the bar is above the center of gravity of said weight, whereby said weight is gravity biased to a position at which said open end of said slot is below said bar; and means for preventing lateral movement of said weights on said bar including grooves in walls defining said slot and an annular rib concentric about said bar, said annular rib extending into said grooves.

12. In an exercise apparatus including a horizontal bar and weights mounted on said bar, the improvement comprising:

a plurality of weights each having a bar receiving slot opening to a lower edge of said weight and a closed end intermediate the height of said weight and sufficiently above the center of gravity of said weight that when said bar is at the closed end of said slot the bar is above the center of gravity of said weight, whereby said weight is gravity biased to a position at which said opened end of said slot is below said bar; and a tether attached to said weight adjacent to the open ended of said slot and ground to a floor, said tether maintaining downward orientation of said slot.

13. In an exercise apparatus including a horizontal bar and weights mounted as said bar, the improvement comprising:

a plurality of weights, each having a bar receiving slot open to a lower edge of said weight and a closed end intermediate the height of said weight and sufficiently above the center of gravity of said weight that when said bar is at the closed end of said slot the bar is above the center of gravity of said weight, whereby said weight is gravity biased to a position at which said open end of said slot is below said bar;

unslotted fixed weights at either end of said horizontal bar and means for securing said fixed weights to said bar, said fixed weights preventing said weights from moving laterally to the outer ends of said bar; and magnet means attached to said weights, said magnets securing said fixed end weights to said weights.

* * * * *